US009838794B2

(12) United States Patent
Reining

(10) Patent No.: US 9,838,794 B2
(45) Date of Patent: Dec. 5, 2017

(54) DOUBLE COIL SPEAKER

(71) Applicant: Friedrich Reining, Vienna (AT)

(72) Inventor: Friedrich Reining, Vienna (AT)

(73) Assignee: Sound Solutions International Co., Ltd., Beijing (CN)

( * ) Notice: Subject to any disclaimer, the term of this patent is extended or adjusted under 35 U.S.C. 154(b) by 542 days.

(21) Appl. No.: 13/871,726

(22) Filed: Apr. 26, 2013

(65) Prior Publication Data

US 2014/0321690 A1 Oct. 30, 2014

(51) Int. Cl.

| | |
|---|---|
| ***H04R 9/02*** | (2006.01) |
| ***H04R 9/04*** | (2006.01) |
| ***H04R 9/06*** | (2006.01) |
| *H04R 3/00* | (2006.01) |
| *H04R 29/00* | (2006.01) |

(52) U.S. Cl.

CPC ..... *H04R 9/02* (2013.01); *H04R 9/041* (2013.01); *H04R 9/063* (2013.01); *H04R 3/007* (2013.01); *H04R 29/003* (2013.01); *H04R 2209/041* (2013.01)

(58) Field of Classification Search

CPC ..... H04R 9/02; H04R 9/025; H04R 9/027; H04R 9/04; H04R 9/041; H04R 9/045; H04R 9/043; H04R 9/047; H04R 9/046; H04R 9/063; H04R 2209/041; H04R 1/24; H04R 3/007; H04R 3/02; H04R 29/003

USPC ..... 381/396

See application file for complete search history.

(56) References Cited

U.S. PATENT DOCUMENTS

| | | | | | |
|---|---|---|---|---|---|
| 2,007,749 | A | * | 7/1935 | Anderson | H04R 1/24 336/129 |
| 3,665,124 | A | | 5/1972 | Sotome | |
| 3,766,334 | A | | 10/1973 | Burke | |
| 4,598,178 | A | * | 7/1986 | Rollins | H04R 3/08 381/354 |
| 4,783,824 | A | * | 11/1988 | Kobayashi | H04R 9/025 381/402 |
| 4,897,877 | A | * | 1/1990 | Tetzlaff | 381/302 |
| 5,197,104 | A | * | 3/1993 | Padi | H04R 3/002 381/401 |
| 5,828,767 | A | | 10/1998 | Button | |

(Continued)

FOREIGN PATENT DOCUMENTS

| | | |
|---|---|---|
| CN | 2265654 | 10/1997 |
| CN | 2324741 | 6/1999 |

(Continued)

OTHER PUBLICATIONS

International Search Report, PCT/MY2014/000071, dated Sep. 8, 2014.

*Primary Examiner* — Davetta W Goins
*Assistant Examiner* — Jasmine Pritchard
(74) *Attorney, Agent, or Firm* — Steven McMahon Zeller; Dykema Gossett PLLC

(57) ABSTRACT

An audio system comprising an electro-acoustic transducer having two stacked voice coils mechanically linked to a membrane. The voice coils are oscillatingly suspended in the magnetic field of a permanent magnet focused by a pole plate and are mechanically arranged symmetrical to the pole plate while in a rest position. The audio system further comprises two driver circuits connected to the electro-acoustic transducer.

11 Claims, 4 Drawing Sheets

FIG.1

(56) References Cited

U.S. PATENT DOCUMENTS

| | | | | |
|---|---|---|---|---|
| 6,148,088 | A * | 11/2000 | Suzuki | H04R 3/007 381/345 |
| 7,676,053 | B2 * | 3/2010 | Nagaoka | H04R 9/025 381/401 |
| 8,199,920 | B2 * | 6/2012 | Valenti, III | H04R 29/00 381/58 |
| 9,173,035 | B2 * | 10/2015 | Button | H04R 9/025 |
| 9,301,072 | B2 * | 3/2016 | Reining | H04R 3/007 |
| 2004/0156527 | A1 * | 8/2004 | Stiles | H04R 9/063 381/412 |
| 2005/0031138 | A1 * | 2/2005 | Browning | H04R 29/003 381/96 |
| 2005/0031139 | A1 * | 2/2005 | Browning | H04R 3/002 381/96 |
| 2006/0104451 | A1 * | 5/2006 | Browning | H04R 29/003 381/59 |
| 2007/0183620 | A1 * | 8/2007 | Stiles | H04R 9/046 381/401 |
| 2008/0025551 | A1 * | 1/2008 | Wehner | H04R 9/04 381/401 |
| 2009/0028371 | A1 * | 1/2009 | Bailey | H04R 9/025 381/386 |
| 2010/0189284 | A1 * | 7/2010 | Kuze | H04R 3/002 381/120 |
| 2012/0294450 | A1 * | 11/2012 | Ozcan | 381/59 |
| 2013/0202122 | A1 * | 8/2013 | Citerin | 381/59 |
| 2014/0056466 | A1 * | 2/2014 | Jenq | H04R 1/403 381/401 |
| 2015/0030167 | A1 * | 1/2015 | Pan | H04R 3/007 381/59 |

FOREIGN PATENT DOCUMENTS

| | | | |
|---|---|---|---|
| CN | 2448040 | | 9/2001 |
| CN | 1450833 | | 10/2003 |
| CN | 1812651 | | 8/2006 |
| CN | 1812656 | | 8/2006 |
| CN | 1812657 | | 8/2006 |
| CN | 200959657 | | 10/2007 |
| DE | 102006052063 | | 5/2008 |
| DE | 102008057673 | | 7/2009 |
| EP | 0471990 | | 4/1995 |
| EP | 2323424 | A1 | 5/2011 |
| EP | 2400784 | A1 | 12/2011 |
| EP | 2472905 | A1 | 7/2012 |
| GB | 2089171 | A | 6/1982 |
| JP | 10276495 | | 10/1998 |
| WO | 9416536 | | 7/1994 |
| WO | 2009064833 | | 5/2009 |

* cited by examiner

DOUBLE COIL SPEAKER

FIELD OF THE INVENTION

The present invention generally relates to an audio system that comprises an electro-acoustic transducer connected to a first and a second driver circuit, which electro-acoustic transducer comprises a first coil concentrically stacked on a second coil mechanically linked to a membrane, with the coils oscillatingly suspended in the magnetic field of a permanent magnet focused by a pole plate.

BACKGROUND OF THE INVENTION

Such audio systems are for instance used in mobile applications like mobile phones or cars. Document EP 0 471 990 B1 discloses such an audio system that comprises an electro-acoustic transducer or speaker with a banked winding consisting of a first coil and a second coil. A first driver circuit is connected to the first coil and a second driver circuit is connected to the second coil to independently feed audio signals to the first and the second coil. In one embodiment disclosed in the document, a stereo audio signal is fed to the speaker, wherein the left audio signal is fed by the first driver circuit to the first coil and the right audio signal is fed by the second driver circuit to the second coil of the speaker. In another embodiment disclosed in the document, the speaker is used in a car, wherein the audio signal from the radio is fed to the first coil and the audio signal from the telephone is fed to the second coil. In both of these disclosed embodiments, audio signals are fed independently to the first and the second coil to achieve an overlaid acoustic signal.

Electro-acoustic transducers are in general hampered by mechanical and electrical nonlinearities that lead to all kind of different acoustic distortions. There are prior art speakers that use the coil of the speaker in a sensor operating mode to sense an electrical signal induced and to process the sensor signal based on a mathematical model of the speaker. A drawback for these solutions is the need for correct static loudspeaker parameters and the restriction of velocity measurement of the system.

SUMMARY OF THE INVENTION

It is an object of the invention to provide an audio system with two coils to reduce or eliminate such acoustic distortions without the need to create a mathematical model of the speaker.

This object is achieved with an audio system wherein the first coil and the second coil are mechanically arranged symmetrical to the pole plate in a rest position.

This mechanical set-up of a speaker allows for a more general sensing as well as a direct method to control offset-, stiffness- or tumbling-induced distortions in realtime without a long way round including a mathematical model of the speaker. It is furthermore advantageous to combine this mechanical set-up with an electrical set-up of the speaker where the first coil and the second coil are arranged in series with one of their electrical connections as common contact to the first and the second driver circuit.

These and other aspects of the invention will be apparent from and elucidated with reference to the embodiments described hereinafter. The person skilled in the art will understand that various embodiments may be combined.

DETAILED DESCRIPTION OF EMBODIMENTS

Figure 1:
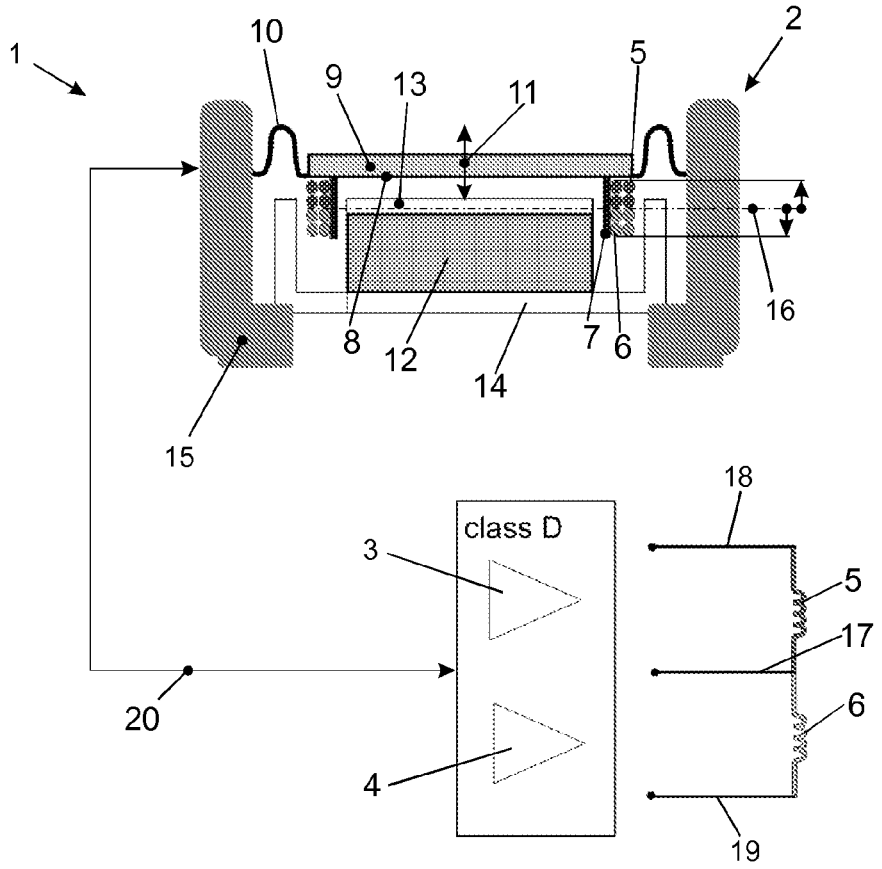
FIG. 1 shows an audio system according to the invention.

FIG. 1 shows an audio system 1 that comprises an electro-acoustic transducer or speaker 2 connected to a first driver circuit 3 and a second driver circuit 4. The speaker 2 comprises a first coil 5 concentrically stacked on a second coil 6 and mechanically linked with a bobbin 7 to a membrane 8. A plate 9 is fixed on the membrane 8, which membrane 8 comprises a crimp 10 to enable movement of the membrane 8 in direction 11. With this mechanical set-up the coils 5 and 6 are oscillatingly suspended in the magnetic field of a permanent magnet 12, which magnetic field is focused between a pole plate 13 and a pot 14. The speaker 2 furthermore comprises a housing 15.

The mechanical set-up of the speaker 2 is arranged in such a way that the first coil 5 and the second coil 6 are mechanically arranged symmetrically to a midline 16 of the pole plate 13 in a rest position of the membrane 8. The rest position of the membrane 8 is the position the membrane 8 is in when it is not moving and the driver circuits 3 and 4 do not drive coils 5 and 6 with an electrical signal. With this mechanical set-up the maximum magnetic flux field is at the rest position of the membrane to enable a strong force $F_{dc}$ caused by an electrical signal in the coils 5 and 6 to move the membrane out of it's rest position.

The electrical set-up of the speaker 2 is arranged in such a way that the two coils 5 and 6 are arranged in series with one of their electrical connections 17 as common contact to the first driver circuit 3 and the second driver circuit 4. This setup is advantageous for it only needs three contacts for the interface. An electrical separation of the coils requires an electrical interface with four connections, which is costly but in some cases could be beneficial for the signal processing by addressing crosstalk issues. In FIG. 1 at the bottom right the first coil 5 and the second coil 6 and their connections to the driver circuits 3 and 4 are shown in a symbolic way. The first coil 5 is connected to the first driver circuit 3 with electrical connections 17 and 18 and the second coil 6 is connected to the second driver circuit 4 with electrical connections 17 and 19, which connections are symbolized by one line 20 to the housing 15 of the speaker 2.

In an initial phase to measure and test the audio system 1 the first driver circuit 3 is arranged to apply an audio signal to the first coil 5 and the second driver circuit 4 is arranged to sense an induced sensor signal in the second coil 6. During normal use of the audio system 1 both driver circuits 3 and 4 apply driver signals to the coils 5 and 6. In the following description there will be explained several different ways to use the above explained electrical and mechanical set-up of the speaker 2 to compensate mechanical and electrical nonlinearities that would lead to all kind of different acoustic distortions.

Offset-detection and Offset-compensation

The actual movement of the membrane 8 results from a sum of several forces, with all of them being dependent in a nonlinear way from the position of the coils 5 and 6. For instance, the driving force factor of the speaker 2 is calculated as B*L , where B denotes the magnetic flux at the position of the coils 5 and 6 and L denotes the length of wire in the magnetic field. In an embodiment, the driving force factor is greatest when the magnetic flux is at its greatest, i.e., at the rest position when the coils are arranged symmetrically to the midline 16 of the pole plate 13. The force factor decreases with increasing excursion of the coils 5 and 6. At the same time, the stiffness of the membrane 8 increases. Both of these nonlinearities further suffer from non-symmetry and other artifacts.

An imbalance in these forces can cause the membrane 8 to be offset from the rest position, resulting in further distortion. This can be minimized, however, if the offset can be adjusted. For a small speaker 2 used in mobile phones, where the peak to peak displacement can be up to 1 mm, an offset of the coils 5 and 6 from the midline 16, and thus an offset in the membrane 8, can be only a few microns.

Figure 2:
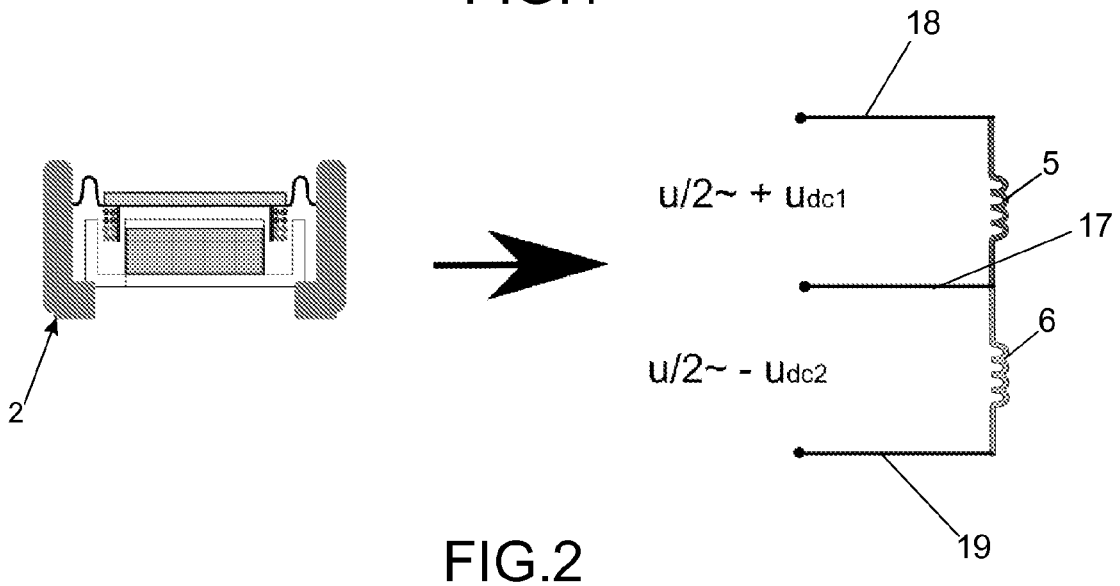
FIG. 2 shows an audio system according to FIG. 1 that is used for offset compensation.

Detection of the offset can be achieved by conducting an online measurement of the current and voltage in the coils 5 and 6. Both coils 5 and 6 face the same magnetic flux B and have the save velocity while moving. Therefore, the same voltage, the "back induced voltage" or EMF, is being induced in both coils 5 and 6. In FIG. 2, which symbolically shows first coil 5, second coil 6 and electrical connections 17, 18 and 19, it can be observed that an online measurement of current and voltage enables an impedance calculation (and an impedance curve) which is affected by the back induced voltage, EMF, around the resonance frequency of the speaker 2. Any offset of the membrane 8 results in more or less magnetic flux compared to the rest position at start up and can therefore be detected by comparison between the initial impedance curve to the impedance curve measured online.

If an offset is detected, a DC voltage $u_{dc}$ applied to one of the coils 5 or 6 shifts the operation point from the rest position to the desired position. This provides the advantage that even if there is a mechanical displacement of the rest position of the particular speaker 2, it is possible to measure this offset and to shift the displaced rest position to the desired position. In the desired position again the maximum magnetic flux field is available symmetrically to both coils. During normal use of the audio system 1 the first driver circuit 3 and the second driver circuit 4 measure the voltage at the electrical connections 17, 18 and 19 of the coils 5 and 6 and measure the current in the coils 5 and 6 to compare the impedance with the impedance detected in the initial phase. The initial phase means normal use of the speaker 2, but without an audio signal applied to the coils. Based on differences detected, one of the drivers is arranged to apply an offset compensation signal $u_{dc}$ to the attached coil in order to compensate for the offset of the membrane 8.

Resonance Control

In mobile applications it is desired to extend the frequency range of speaker 2 to lower frequencies. Extending the frequency range to lower frequencies is limited by excursions that are maximal near the resonance frequency of the whole system. Whereas the mass is predominantly defined by the moved membrane 8 and coils 5 and 6 with the bobbin 7 and the stiffness of the resonant system results from the membrane stiffness and the backvolume stiffness.

Today's miniaturization results in a small backvolume with a high impact on the resulting (higher) resonance frequency when compared with the speaker 2 itself. There are several ways to lower the resulting resonance frequency, such as:

Increasing the backvolume virtually with an air adsorbing material.

Motion control with an external sensor.

A speaker model.

The simplest way is to add an adaptive filter to lower the excursion of the membrane 8 near the resonance frequency and to boost the excursion of the membrane 8 for low frequencies what will only work for simple sine sweeps, but fail for real world audio signals. For the instantaneous membrane position it is a complex function of nonlinear elements influenced by speed, acceleration and stiffness.

Another way to lower the resonance frequency of the audio system 1 is by applying a position dependent force (high force for high excursions) comparable to a softer spring.

Figure 3:
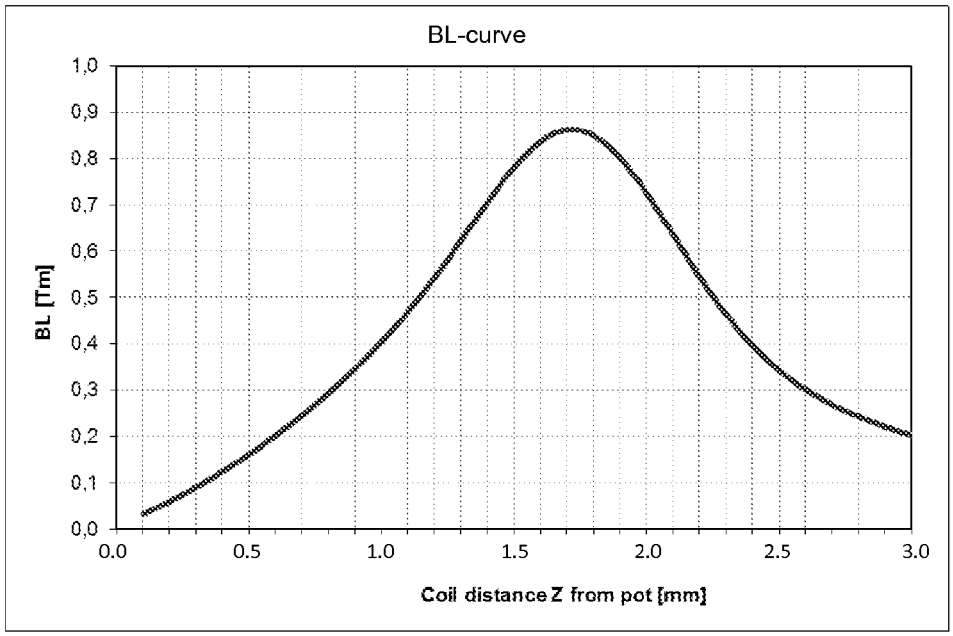
FIG.3 (Prior Art)
FIG. 3 shows the nonlinear shape of the force factor for the excursion of the membrane of a speaker.
Figure 4:
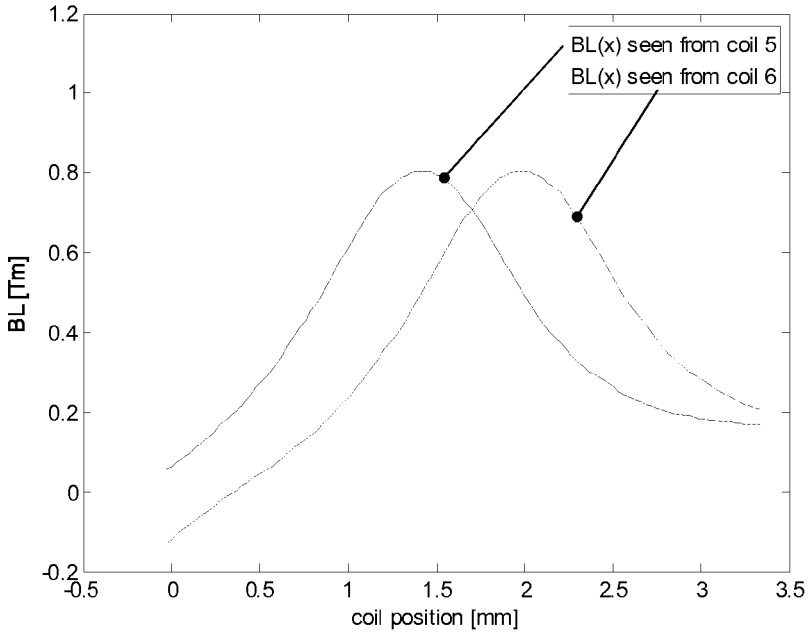
FIG. 4 shows the dependency between the force factor and the coil position for the two concentrically stacked coils of the audio system of FIG. 1.

FIG. 3 is a BL curve of a single coil, which is a plot of the driving force factor BL against the distance x of the coil from the pot 15. As can be seen, the available force $F_{dc}$ is decreasing for increasing excursions causing even higher resonance frequencies. Using the double coiled audio system 1 offers ways to benefit from the nonlinear shape of the driving force factor BL(x). FIG. 4 shows the dependency between the driving force factor BL and the position x of the concentrically stacked coils 5 and 6.

Figure 5:
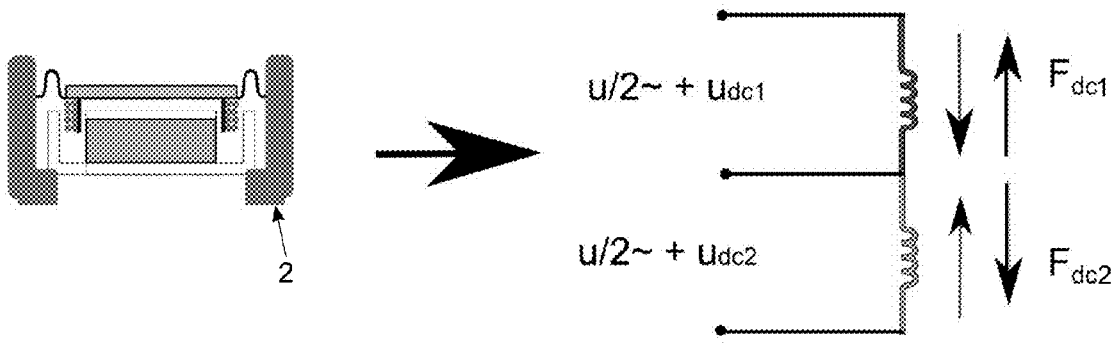
FIG. 5 shows an audio system according to FIG. 1 that is used for resonance control.

When a DC voltage $u_{dc}$ is applied to only one of the coils 5 and 6, the result is an offset as explained above for the offset compensation feature. According to this embodiment, for resonance control the DC voltage $u_{dc}$ is supplied to both coils 5 and 6, but with swapped signs. As can be seen in FIG. 5 this results either in a DC force $F_{dc1}$ and a DC force $F_{dc2}$ with directions towards the middle or to the outside.

Figure 6:
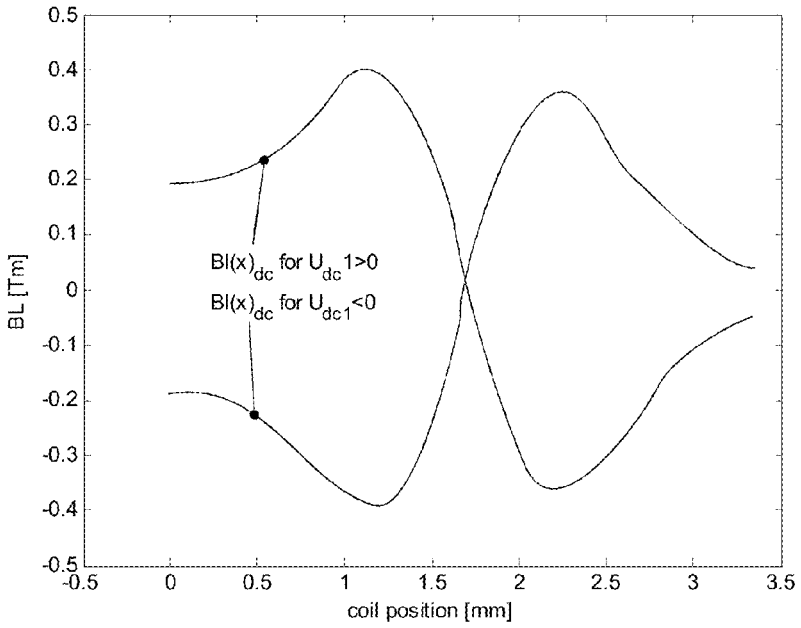
FIG. 6 shows the two force factors applied to the coils that result in a stiffness control of the audio system of FIG. 1.
Figure 7:
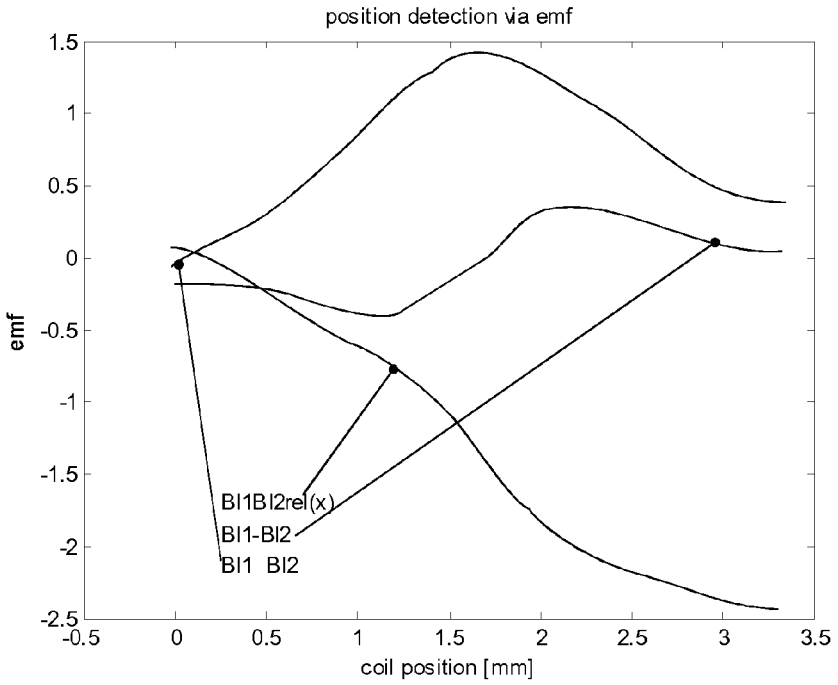
FIG. 7 shows the relation of the back induced voltage (EMF) and the coil position that is used to detect the coil position.

The resulting shape of the additional force $F_{dc}$ for different DC voltages $u_{dc}$ can be seen in FIG. 6. Because the resulting function is odd, this additional force $F_{dc}$ acts as a stiffness control for the speaker 2. In case of a positive DC force $F_{dc}$ (force towards the middle) the additional force can be interpreted as if the stiffness of the whole audio system 1 becomes softer and vice versa.

Note that the range in which this resonance control feature works is limited to the "linear" part of force $F_{dc}$ which fortunately matches the allowed excursion for speaker 2 when used in a mobile device, which is in the range of 1.3 to 2.3 mm from the pot 14 and peak to peak excursions of about 0.3 mm.

An example of a simplified linearized calculation shows, that a speaker with 70 mg mass and a resonance frequency at 500 Hz shows audio system resonance with 1.8 $cm^3$ backvolume at about 800 Hz. To shift that audio system resonance to 730 Hz needs either a 3 $cm^3$ backvolume or a DC current of ~200 mA (300 mW).

This means that the first driver circuit 3 is arranged to add the DC resonance control signal $u_{dc}$ to the audio signal applied to the first coil 5 and that the second driver circuit 4 is arranged to subtract the DC resonance control signal $u_{dc}$ from the driver signal applied to the second coil 6 in the optimization mode to increase the stiffness of the speaker 2. It is particular advantageous that the first driver circuit 3 and the second driver circuit 4 are arranged to add/subtract the DC resonance control signal $u_{dc}$ for high excursions of the membrane 8, i.e., above a predetermined threshold, only to save energy.

Position Detection

It is not possible to use the nonlinear shape as a position detector for a single coil system, as it is only possible to track the induced voltage which is a function of magnetic flux field B times velocity. First of all we need a representation of the back induced voltage (EMF). If we measure the induced current and induced voltage simultaneously to measure the actual impedance $Z_{dc}$ of the coils 5 and 6 (where Z denotes the complex valued impedance R+jωL) we can derive the induced voltage by the formula:

$$e.m.f_{coil5}=uc5=U_{coil5}-Z_{dc,coil5}*I_{coil5} \quad (1)$$

$$e.m.f_{coil6}=uc6=U_{coil6}-Z_{dc,coil6}*I_{coil6} \quad (2)$$

For a single coil system this value equals the product of B*L and v (velocity) which can be integrated to gain the position, but lacks the constant during integration. The double coil system offers a way to distinguish between the B field and velocity v and therefore finds a stable estimate of the position at any time.

Since both coils move with the same velocity we need to make use of a formula, in which the induced voltages of both coils are set into relation to each other. The derived formulas are:

$$\text{sumdiff}=abs[(uc5+uc6)/(uc5-uc6)] \quad (3)$$

$$\text{distinct}=abs[uc5/uc6] \quad (4)$$

Note: sumdiff and distinct are rid of velocity!

$$\text{Bvspos}=\text{sumdiff}*(-\text{sign}(\text{distinct})) \quad (5)$$

$$\text{Bvspos_shifted}=(1-\text{sign}(\text{distinct}))*\min(\text{Bvspos}) \quad (6)$$

$$BL1BL2\text{rel}(x)=\text{Bvpos}+\text{Bvpos_shifted} \quad (7)$$

BL1BL2rel(x) is a signal being distinct, but nonlinearly dependent on the position of the coils 5 and 6 and can be derived from measurement of $U_{coilx}$, $I_{coilx}$ and $Z_{dc,coilx}$. Based on above formulas, therefore, it is possible to detect the actual position of the membrane 8 of the audio system 1 given the shape of BL(x).

Tumble Detection

Although the resulting force in a dynamic loudspeaker like the speaker 2 produces movements (direction 11) perpendicular to the surface of membrane 8, small orthogonal force components are unavoidable. These components result in tumbling of the membrane 8, which means that for such a movement the acoustic flow is zero even though the membrane 8 is moving in a rotational manner.

To optimize the performance of speaker 2 mandatorily leads to maximizing force by minimizing the airgap between pot 14 and the coils 5 and 6. The tumbling movement contradicts a small airgap, which means that tumbling in a narrow airgap causes a periodic touching of the coils 5 and 6 with the pot 14 what leads to a bad acoustic of the speaker 2 (e.g. rubb and buzz).

A simple way to overcome tumbling is to damp the whole audio system what influences other parameters as well as efficiency.

Since for a single coil the rotational center is found within the center of gravity, any induced voltage due to the tumbling movement is being cancelled out. It is not a simple task to find a reliable electrical footprint in the impedance curve of a single coil system.

Figure 8:
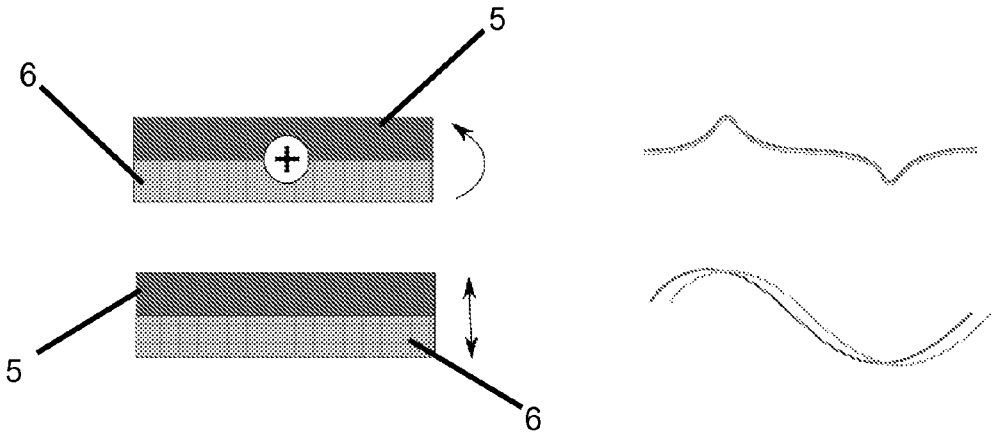
FIG. 8 shows the shape of induced voltages in the two coils of the audio system according to FIG. 1 in case the membrane is tumbling, which can be used for tumble detection.

For the double coil system like the audio system 1, the center of gravity is found at the interface between the coils 5 and 6. A rotational movement therefore induces a voltage, which is not cancelled completely as can be seen from FIG. 8. There is a phase delay between the induced voltage measured in each of the coils 5 and 6. A rotational movement induced voltage is characterized by a zero phase delay and can therefore be detected in the phase information of the impedance measurement.

Note that tumbling in real life occurs as an additional rotational movement to the major linear up and down movement. Nevertheless there is a way to distinguish the induced voltage whether originated by tumbling or linear movement.

Once the critical tumble frequencies are detected a certain number of adaptive notch filters can damp very selective these frequencies in the electric domain of the amplifier.

This means that for tumble detection the audio system 1 comprises phase delay detection means to detect a phase delay between the voltages induced in the first coil 5 and the second coil 6 of the audio system 1. Filter means damp the frequencies of the audio signal that comprise a phase delay in the sensor signals.

Speaker Parameters Storage

Standard flash memory components require at least 3 pins. The audio system 1 offers a simple way to use the three connections 17, 18 and 19 as a flash memory interface, which can be addressed by a certain electrical pattern. In order not to destroy the speaker 2 during programming and reading by overstressing the membrane 8 with DC, a low voltage flash has to be used (1.5V).

Compatibility and Efficiency

The double coil audio system 1 requires two driver circuits 3 and 4 with two amplifiers, both of them connected to one of the coils 5 and 6. If the double coil speaker 2 shows a nominal impedance of 8Ω, each of the coils 5 and 6 contribute with 4Ω. Power performance for mobile devices is obviously restricted to the voltage of the battery found within the device.

If we compare a single voice coil system to the double voice coil audio system 1 with a battery voltage of e.g. 3.7 Volts and neglecting all losses, we find a max. power available for an 8Ω speaker of $$P_{singlecoil}=\frac{U^2}{R}=\frac{3.7^2}{8}=1.7 \text{ Watts}$$

$$P_{doublecoil}=2\left(\frac{U^2}{R/2}\right)=6.8 \text{ Watts}$$

This means that a higher power can be achieved at a given battery voltage or the same power with less battery voltage. As seen from this example compatibility to state of the art speakers is given by simply connecting the double coil speaker 2 at those coil interfaces which are not common for both coils.

Advantage of the Proposed Solution

State of the art speaker amplifier combinations sense several parameters as well, but lack the robustness of direct corrective actions for they have to go a long way round a mathematical speaker model. This mathematical speaker model is dependent on correct static speaker parameters in order to predict correct output of the speaker and therefore to find inverse filter parameters to cancel unwanted effects out.

The concept of a double coil audio system 1 offers the above explained features to improve speakers' performance, robustness and lifetime more directly as well as the position.

The double coils 5 and 6 allow for sensing several parameters, but offers immediate actions to directly correct for offset deviations, stiffness deviations or tumbling via the electric interface. No static speaker parameters except BL(x) are required, all parameters are measured online and referred to a calibration measurement. All features outlined above relate to real life situations which can decrease the speaker performance or even destruct a speaker 2 completely due to overstress.

The speaker in above disclosed embodiments of the invention comprises an electrical set-up where the first coil and the second coil are arranged in series with one of their electrical connections 17 as common contact to the first driver circuit 3 and the second driver circuit 4. In another embodiment of the invention the first coil and the second coil are electrically separated from each other and therefore comprise four electrical contacts. This enables the ability to drive the coils with separated signals, as might be advantageous for some applications of use of the speaker.

What is claimed is:

1. An audio system comprising:

an electro-acoustic transducer comprising:

a membrane;

a permanent magnet;

a pole plate configured to focus the magnetic field of the permanent magnet;

a first coil mechanically linked to the membrane;

a second coil mechanically linked to the first coil, the first coil and second coil being oscillatingly suspended in the magnetic field of the permanent magnet;

wherein the first coil is stacked on top of the second coil in the direction of movement of the membrane, the first coil and the second coil further being mechanically arranged symmetrically about a midline of the pole plate in a rest position, the midline being substantially perpendicular to the direction of movement of the membrane; and a first driver circuit and a second driver circuit, the first and second driver circuits being connected to the electro-acoustic transducer.

2. The audio system according to claim 1, wherein the first coil is electrically connected to the first driver circuit and the second coil is electrically connected to the second driver circuit.

3. The audio system of claim 2, wherein the first coil and the second coil are electrically arranged in series and wherein one of the electrical connections between the first coil and the second coil is a common contact to the first driver circuit and the second driver circuit.

4. The audio system according to claim 1, wherein the first driver circuit is configured to apply an audio signal to the first coil and the second driver circuit is configured to apply an audio signal to the second coil.

5. The audio system according to claim 4, wherein the first driver circuit is configured to add a DC resonance control signal to the audio signal applied to the first coil and the second driver circuit is arranged to subtract the DC resonance control signal from the audio signal applied to the second coil.

6. The audio system according to claim 5, wherein the first driver circuit and the second driver circuit are configured to add and subtract, respectively, the DC resonance control signal when the excursion of the membrane is above a predetermined threshold.

7. The audio system according to claim 1, wherein the first driver circuit and the second driver circuit are each configured to measure the current and voltage induced in the first coil and the second coil, respectively.

8. The audio system according to claim 7 further comprising means to detect the position of the membrane that is configured to calculate the actual position of the membrane based on the formula BL1BL2rel(x)=Bvpos+Bvpos_shifted using the current and voltage measured by the first and second driver circuits.

9. The audio system according to claim 7 further comprising means to detect a phase delay between the voltage induced in the first coil and the voltage induced in the second coil.

10. The audio system according to claim 1, further comprising a non-volatile memory having three memory connections configured to store parameters of the audio system, wherein the three memory connections are connected with the three connections of the first coil and the second coil.

11. The audio system according to claim 9, further comprising filter means configured to damp frequencies of an audio signal that comprise a phase delay in the voltages induced in the first and second driver circuits.

* * * * *